United States Patent [19]

Phlipp

[11] Patent Number: 4,557,195

[45] Date of Patent: Dec. 10, 1985

[54] PAD-TYPE PRINTING MACHINE AND PLATE INKING ASSEMBLY THEREFOR

[76] Inventor: Wilfried Phlipp, Lenbachstrasse 8, D 7014 Kornwestheim, Fed. Rep. of Germany

[21] Appl. No.: 654,195

[22] Filed: Sep. 24, 1984

[30] Foreign Application Priority Data

Sep. 29, 1983 [DE] Fed. Rep. of Germany ..... 3335230

[51] Int. Cl.[4] ..... B41K 3/54; B41F 15/40

[52] U.S. Cl. ..... 101/163; 101/167

[58] Field of Search ..... 101/35, 41, 44, 163, 101/150, 155, 157, 167, 169

[56] References Cited

FOREIGN PATENT DOCUMENTS

| | | | |
|---|---|---|---|
| 61093 | 9/1982 | European Pat. Off. | 101/169 |
| 1923374 | 2/1970 | Fed. Rep. of Germany | 101/163 |
| 2205430 | 6/1981 | Fed. Rep. of Germany | 101/163 |
| 1135819 | 12/1968 | United Kingdom | 101/163 |
| 527309 | 2/1977 | U.S.S.R. | 101/41 |

OTHER PUBLICATIONS

Oberg, et al., *Machinery's Handbook*, Twentieth Edition, 1978, pp. 2112–2119.

*Primary Examiner*—Clifford D. Crowder

*Attorney, Agent, or Firm*—Poms, Smith, Lande & Rose

[57] ABSTRACT

A pad-type printing machine with a mount for a cliché, with an ink supply device exhibiting a hollow body, whereby during the operation of the machine the end face of the hollow body rests at least occasionally on the cliché, with a device for pressing the end face of the hollow body against the cliché, with a device for producing a relative motion between the cliché and the hollow body, whereby the hollow body is guided such that it can swivel about an axis extending basically parallel to the relative motion, and with a pad which can be pressed onto the inked cliché and which accepts the ink from the recesses in the cliché and transfers it onto an object to be printed is characterized by the fact that at least on some of the circumference of its end face the hollow body comprises hard material and is microfinished with a peak-to-valley height of at most 2 μm whereby the device for pressing the hollow body against the cliché is designed such that the contact force acts in the immediate vicinity of the contact surface between the cliché and the hollow body and is at least approximately uniformly distributed over the circumference of the end face, whereby the hollow body is guided such that it can additionally swivel about an axis extending transversely to the relative motion between the cliché and the hollow body. This permits a high working speed with only little outlay on maintenance. (FIG. 1).

8 Claims, 14 Drawing Figures

PAD-TYPE PRINTING MACHINE AND PLATE INKING ASSEMBLY THEREFOR

BACKGROUND OF THE INVENTION

The invention relates to a pad-type printing machine with a mount for a cliché, with an ink supply device exhibiting a hollow body, whereby during the operation of the machine the end face of the hollow body rests at least occasionally on the cliché, with a device for pressing the end face of the hollow body against the cliché, with a device for producing a relative motion between the cliché and the hollow body, whereby the hollow body is guided such that it can swivel about an axis extending basically parallel to the relative motion, and with a pad which can be pressed onto the inked cliché and which accepts the ink from the recesses in the cliché and transfers it onto an object to be printed.

In a known machine of this kind (DE-C No. 22 05 430) in which the hollow body forms a pot which is open on one side only, this pot is seated on the cliché. The pot is moved over the cliché in a reciprocating motion by means of a driving device. During the outward motion the cliché is inked whereby the ink inks both the recesses of the cliché which is engraved in the manner of a gravure plate as well as the remaining flat surface of the cliché, and on the return motion the hollow body leaves the area of the cliché, and a wiping blade or doctor blade disposed behind the hollow body and displaceable with the latter skims off excess ink from the surface of the cliché so that the ink is left only in the recesses of the cliché from where it is accepted by the pad. After accepting the ink from the cliché, the pad is pivoted on an arm and then prints an object. Although, in this machine, the lip of the pot has a certain wiping effect, it is not capable of wiping the cliché completely clean without an additional wiping blade. The lip of the pot in the known machine consists of a relatively soft material, namely a plastic.

The device for pressing the end face of the hollow body against the cliché exhibits a lever which is mounted about an upper horizontal swivel shaft in a machine frame and which is pressed downward by a spring, whereby mounted on its lower end by means of a horizontal swivel shaft extending parallel to the first-mentioned shaft is a ring which is slipped over the hollow body and presses on a projecting collar of the hollow body. The number of printing operations which can be executed by the known machine each hour is limited by the fact that the distances the moving parts have to cover cannot be passed through in as short a time as desired because otherwise excessive acceleration of these parts would occur. Furthermore, if the rate of motion is raised too greatly, there is the possibility that the wiping blade will lift off the surface of the cliché because the ink on the surface of the cliché which is more or less liquid or pasty might cause the wiping blade to float up with the result that the cliché can no longer be cleanly wiped off.

SUMMARY OF THE INVENTION

The object of the invention is to create a machine of the initially depicted kind whose working speed can be increased as compared to the known machine and which requires little maintenance work.

The object of the invention is achieved in that at least on some of the circumference of its end face the hollow body exhibits hard material and is microfinished with a peak-to-valley height of at most 2μm whereby the device for pressing the hollow body against the cliché is designed such that the contact force acts in the immediate vicinity of the contact surface between the cliché and the hollow body and is at least approximately uniformly distributed over the circumference of the end face, whereby the hollow body is guided such that it can additionally swivel about an axis extending transversely to the relative motion between the cliché and the hollow body.

The advantage of the invention is that a separate wiping blade is no longer necessary because the microfinished part of the end face itself acts as a wiping blade. The pressing device is able to guarantee that even at high relative velocities between cliché and hollow body, there can be no lifting off of the part of the end face acting as a wiping blade.

The fact that the contact force acts in the immediate vicinity of the contact surface between the cliché and the hollow body (or in the immediate vicinity of the lower end face of the hollow body) results in favourable lever conditions which make it easily possible to prevent a tilting of the hollow body as a result of the frictional force between the hollow body and the cliché during the relative motion between these two parts. It has become apparent that the fact that the contact force acts on the hollow body in the immediate vicinity of the aforementioned contact surface, for example by a spring acting on an appropriately low-lying projection of the hollow body, or by spring-loaded pins acting on an appropriately low-lying surface of the hollow body, is important for preventing tilting, even if the difference in the lever conditions as compared with those designs in which the contact force acts at a greater distance from the contact surface appears only slight. Such tilting might lead to very high forces between the end face of the hollow body and the cliché, as a result of which there would be the danger of damage. Furthermore, such tilting might lead in regions of the end face to an impermissibly great gap between the cliché and the hollow body through which ink might escape in detrimental quantities.

The fact that the contact force is distributed at least approximately uniformly over the circumference of the hollow body prevents tilting of the hollow body, and the latter closely abuts on the cliché in all places even during the relative motion. Conversely, with the initially described, known device, if the hollow body were equipped with a wiping edge made of hard material, it would not be possible to bring the entire end face of the hollow body into leak-tight contact with the cliché. The feature according to the invention whereby the hollow body is guided such that it can swivel about two axes means that the hollow body can position itself perfectly on the cliché with its entire end face. Thus, the end face which is pressed against the cliché by the pressing device can always set itself parallel to the surface of the cliché.

The fact that a separate wiping blade is not required saves the additional space for the wiping blade, and, consequently, the distances which have to be covered by the moving parts of the machine according to the invention are reduced as compared to the known machine. Hence, without increasing the rate of motion, it is possible to raise the working speed of the machine, namely the number of printing operations per unit of time.

The hard material can be machined to great accuracy and does not change its shape over long periods of time, even if use is made of printing inks containing constituents which have an abradant effect if allowed to act over a long period of time. Nor does the hollow body damage the cliché which is preferably formed by an engraved or etched steel plate. Other materials are also possible for the cliché. At present, however, plastic (due to its softness) and glass (due to its great friction) are not considered as being suitable. The hard materials which come into consideration are, in particular, cemented carbides or also ceramics. The final shaping of the end face in the region of its contact with the cliché is best performed by lapping in the case of these hard materials.

If, as described in the specimen embodiment, the cliché is flat, then the end face of the hollow body also lies in one plane.

In section the end face may exhibit a shape which is similar to the cross section of known wiping blades; in particular, it is advantageous if the end face is seated on the cliché with only a relatively narrow section because this favours reliable wiping off of the ink.

For the sake of simplicity, it is to be assumed in the following that the cliché moves while the hollow body is stationary; this is also true of the subsequently described specimen embodiment. If the end face of the hollow body is designed merely over a part of its circumference such that it can act as wiping edge or wiping blade, then it is sufficient for this part of the end face to be situated on that side of the hollow body on which, after inking and wiping off by the aforementioned part of the end face, there is also the inked cliché from which the ink is then accepted by the pad. In this case, namely, the part of the end face acting as wiping edge guarantees that that part of the cliché which comes under the region of the pad is properly wiped off. If the other parts of the end face fail to form such a perfect seal with respect to the surface of the cliché, this only means that the region of the cliché lying beyond the hollow body as viewed from the pad may possibly be inked slightly more heavily and that ink will build up there in the course of time. It may then be necessary to perform cleaning more frequently in that place.

In order largely to prevent the build-up of too much ink on any one side of the cliché, which might interrupt the working process in order to effect cleaning, a preferred embodiment provides that the end face of the hollow body is designed over its entire circumference such that it can act as a wiping edge, as a result of which the escape of ink can be prevented, even if not entirely, to such an extent that cleaning of the cliché is in the worst case necessary at intervals of several hours. Preferably, the hollow body consists in the region of its entire end face of hard material or is coated with hard material.

Preferably, the contact force is adjustable so that it can be adapted to the respective requirements. The contact force depends on the size of the contact surface between the hollow body and the cliché.

In an embodiment of the invention the hollow body is supported in a housing accommodating it against shifts with respect to the housing parallel to the relative motion between the cliché and the hollow body by a lateral support in the vicinity of the contact surface between the cliché and the hollow body. This low-flying support, namely in the vicinity of the contact surface, keeps down the torques which are produced by the relative motion and which attempt to lift the end face of the hollow body partially off the cliché.

Preferably, the lateral support for the hollow body is fixed on the housing. This feature means of necessity that this support is completely independent of the generation of the contact force acting on the hollow body. This once again aids the reliable contacting of the end face of the hollow body on the cliché.

In an embodiment of the invention the hollow body is swivel-guided by a bearing exhibiting an arched surface. This may be, for example, a spherical bearing or, in another embodiment of the invention, a bearing exhibiting an annular support bearing with a convex inner surface against which a mating surface of the hollow body is supported. In this connection, the term ¢annular" is to comprise both a circular arrangement as well as an angular arrangement, particularly a square arrangement. In other embodiments the lower end region of the hollow body may exhibit an outward-projecting bead which forms the rounded support surface which is supported against flat mating surfaces (in the case of a rectangular cross section of the hollow body) or against a circularly cylindrical mating surface (in the case of a round cross section of the hollow body).

In the machine according to the invention the hollow body may be in one piece. In embodiments of the invention, however, the hollow body comprises more than one piece and exhibits parts which are movable in relation to each other and are joined together such as to be leak-tight in respect of liquids, and a part of the end face is provided on one part of the hollow body, and another part of the end face on another part of the hollow body. This embodiment permits dimensional changes of the hollow body in the region of its end face, namely a shortening of the dimensions without having to enlist the help of the manufacturer of the cemented-carbide part or of the cemented-carbide coating. This embodiment also simplifies the overall manufacture of the hollow body. The aforementioned leak-tight joined between the parts of the hollow body can be formed by a liquid-tight abutment of the parts without these parts having to be rigidly or even permanently joined together.

The hollow body may be formed from more than two parts; in general, however, it is easier to manufacture the hollow body from not more than two parts.

In an embodiment of the invention the hollow body is divided into two parts, each of which exhibits a wall, two side walls disposed at right angles to the latter, and a ceiling wall extending basically at right angles to the wall and the side walls, whereby the side walls of the two parts abut on each other with end faces extending basically at right angles to the plane of the cliché. The adjoining surfaces of the parts which are movable in relation to each other are highly accurately level, particularly flat, and lapped so that they abut on each other in such a way as to be leak-tight in respect of liquids and prevent the escape of ink from the hollow body. Preferably, the two parts are pressed against each other by a spring force.

Conversely, in other embodiments of the invention, one of the two parts of the hollow body may be formed by a basically flat plate.

In other embodiments of the invention the clamping device is designed such that the individual parts of the hollow body are pressed against the cliché, and in one embodiment each of the parts of the hollow body has its own clamping device. This favours reliable contacting of the individual parts of the end face on the cliché.

In the various described embodiments of hollow bodies, the hollow body or its individual parts is so solid in the region of the end face that it can be viewed as being absolutely rigid. In embodiments of the invention the end face may be slightly rounded. This is advantageous particularly if one of the parts of the hollow body can be seated, variously inclined, on the cliché.

In the embodiments in which the hollow body has a rectangular cross section, the end faces extending parallel to the direction of displacement do not have a wiping function, but merely the function of sealing aprons which are designed to prevent the escape of ink. It appears possible, without a loss of quality, to replace these sealing aprons by elastic parts made of metal or plastic. It should also be remembered that in the region of these sealing aprons the cliché does not exhibit any etching, but is completely smooth.

Unlike the subsequently described specimen embodiment and in agreement with the known machine, one embodiment of the invention provides that the hollow body is held in a transporting device which moves in relation to the cliché.

Another embodiment of the invention which has already been referred to several times, however, provides that the hollow body is basically immovably disposed in the machine and a driving device is provided to move the cliché.

This last-mentioned embodiment can be further developed such that the cliché, or more accurately that part of the cliché containing the inked and wiped engraving, is situated in the path described by the pad during the printing of the object to be printed. When accepting the ink from the cliché, the pad thus only partially covers this just-mentioned path, and after the ink has been accepted and when the pad is no longer in contact with the cliché, the cliché is moved under the hollow body for re-inking, and the pad can now print the aforementioned object. This embodiment is particularly suitable for the printing of objects in a production line or conveying line at points which are difficult to reach. The cliché and the hollow body of the pad-type printing machine may, for example, be situated above the production line, and the pad be connected to a sufficiently long connecting rod which makes it possible, after the ink has been accepted from the cliché, to move the pad downward through a possibly considerable distance in order to print the object in a place at which there would not be space for the complete pad-type printing machine. Particularly if the print which is to be applied is relatively small in area, i.e. only a few millimeters or a few centimeters in size, the pad can also be relatively small and light and can, therefore, while being of simple design, move quickly so that a large number of printing operations can be performed per unit of time. If the ink is to be removed from the hollow body without tilting the machine, it is possible by means of a suitable arrangement to ensure that, by means of lateral shifting, the cliché can be moved away sufficiently from the hollow body such that the ink can be drained downward. The removal of the ink from the hollow body without the danger of dirtying is favoured by a further device described below.

Since, given relatively small dimensions of the machine, as described, for example, with reference to the specimen embodiment, one filling of the hollow body is sufficient for several hours of operating time of the machine or even for an entire shift (about 8hours), it is not absolutely necessary to ensure that the hollow body can be topped up with ink during operation of the machine. However, this can, if required, easily be done either continuously or periodically through an opening on the top side of the hollow body.

In an embodiment of the invention, the cliché carrier which holds the cliché is, in the direction of the relative motion between the cliché and the hollow body, at least twice as long as the length of the print to be made. According to the above-described embodiment, this allows, firstly, convenient accepting of the ink by the pad, and, secondly, this also makes it possible, in an embodiment of the invention, to further develop the machine such that the cliché carrier is designed to hold a number of plates such that one of the plates can be exchanged while another of the plates completely closes off the hollow body whereby at least one of the plates is a cliché, i.e. exhibits an engraving to accept printing ink, whereby the plate(s) which does (do) not form a cliché is (are) microfinished in the manner of a cliché on its (their) side facing the hollow body. The upper sides of both plates abut on each other steplessly, i.e. they are, at least in their region of contact, in the same plane.

In the simplest case, in this embodiment of the invention, there are two plates, namely a cliché and a plate which, while not engraved, is identical with the cliché as regards the quality of its surface. The non-engraved plate seals the hollow body during those times in which the cliché is in the position in which the ink can be accepted from the cliché by the pad. With the cliché in this position, the cliché can also be exchanged for a different cliché while the machine is stationary. It goes without saying that, instead of the depicted non-engraved plate, it is also possible to provide a further cliché, particularly if the machine is so designed that the ink can be taken from both clichés by one or more pads. An engraved cliché is just as suitable as a non-engraved plate for sealing off the hollow body while exchanging a cliché.

In an embodiment of the invention one of the plates provided for insertion in the cliché carrier is designed such that its surface facing the hollow body makes a leak-type joint with the latter's end face whereby the plate exhibits an opening through which printing ink contained in the hollow body can be discharged.

Preferably, the plate can be provided with a container into which the ink draining from the hollow body is collected so that any danger of dirtying the machine is prevented. As mentioned above, it may be practical, to allow the ink to drain, to open a filler opening in the hollow body in order to permit the entry of air.

The hollow body may, at least in its lower region, i.e. in the region of the end face of the hollow body, exhibit such a large cross section that it completely covers the engraving on the cliché. In the case of a machine for a cliché of specified maximum width—which is limited by the width of the cliché carrier—and of specified maximum length—which is limited by the possible displacement motion—it is then necessary for the hollow body in the region of its open end face to have a cross section which is adapted to this maximum possible engraving. It is, however, possible, as viewed in the direction of the relative motion between hollow body and cliché, to make the hollow body shorter than the cliché with the result that the cliché can never, over its full length, be within the cross section of the end face of the hollow body. Due to the relative motion, however, the cliché is still inked over its entire length and is wiped off by the lip of the hollow body which acts as a wiping blade.

However, it is also possible for the dimensions of the hollow body transverse to the relative motion between cliché and hollow body to be smaller than corresponds to the width of the engraved area when, as provided for in an embodiment of the invention, several hollow bodies are distributed over the width of the cliché transversely to the direction of the relative motion between the cliché and the hollow body. This embodiment may be practical because it is easier and cheaper to produce a plurality of relatively small hollow bodies than one single large hollow body, and because these small hollow bodies can be used in the appropriate number for a plurality of machines which differ by having a different permissible width of the cliché.

It may be practical, as in an embodiment of the invention, for at least one of the hollow bodies to be offset in the direction of the relative motion between hollow body and cliché.

If several hollow bodies are provided, this makes it possible to ink a cliché simultaneously with different colours of ink.

Further features and advantages of the invention will become apparent from the following description of specimen embodiments of the invention with reference to the drawings showing basic details of the invention, and from the claims. The individual features may be implemented in an embodiment of the invention either separately and alone or in any desired combination.

DESCRIPTION OF THE PREFERRED EMODIMENTS

Figure 1:
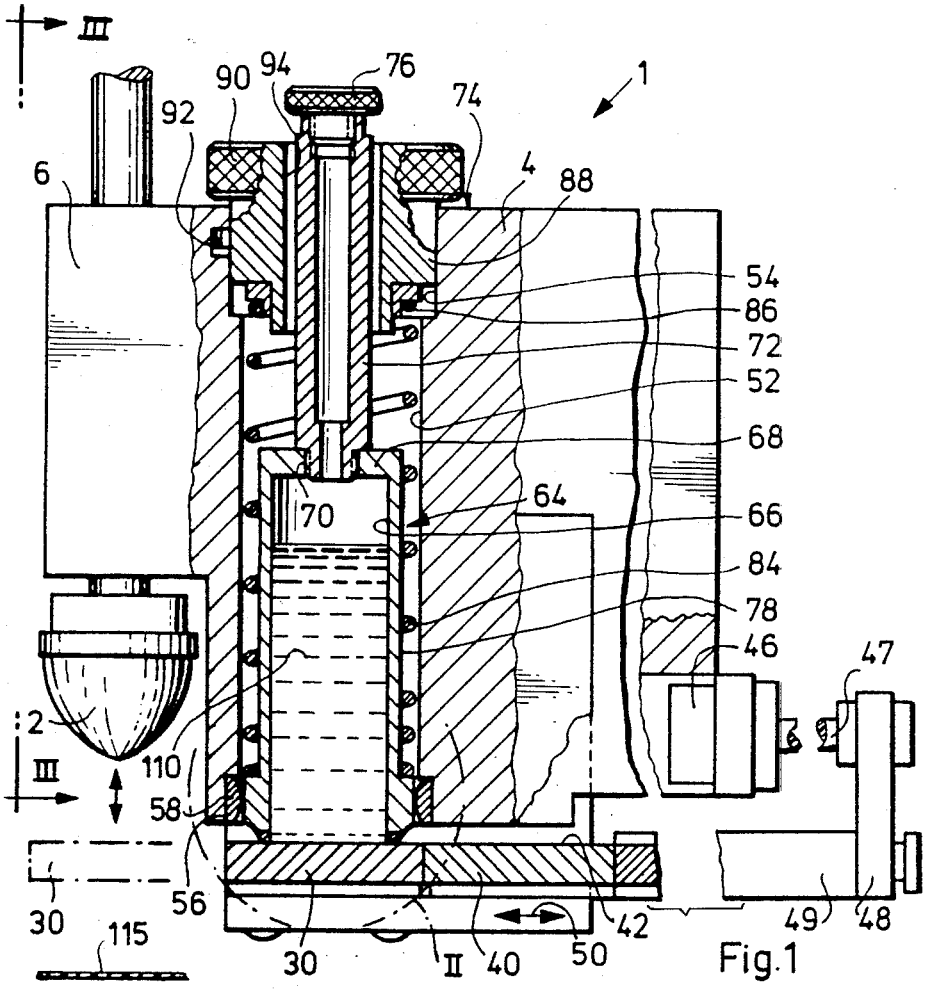
FIG. 1 shows a longitudinal section through a specimen embodiment of a pad-type printing machine for applying markings to objects to be printed at a high printing rate.

The drawings merely show those details which are necessary for understanding the invention.

The machine 1 which is a pad-type printing machine for the rapid printing of even surfaces and preferably of objects with uneven surface by means of a silicone rubber pad 2 exhibits a basic body or a machine frame 4 on which the other parts of the machine are disposed. On the front side of the machine 1 which is on the left in FIG. 1, the pad 2 is attached to a guide piece 6 which projects forward over the remaining frame 4. More precisely, the pad 2 is attached to a guide column 8 which is vertically displaceably held in the guide piece 6. The guide column 8 is connected to the pad 2 by means of a holding plate 10 on which is attached the lower end of a piston rod 12 of a pneumatic piston-cylinder unit 14. Also attached to the holding plate 10 is a trip rod 16 which is disposed parallel to the longitudinal direction of the piston-cylinder unit 14 and of the guide column 8 and which bears height-adjustable trip cams 17 and 18 which interact with limit switches (not shown) and serve to set the stroke length of the pad 2.

Spaced apart and bolted parallel to each other onto the side of the frame 1 are two mounting plates 19 and 20 which in their lower end region each bear several upper guide rollers 21 (which are all disposed at the same height in one plane) and several lower guide rollers 22 (which are disposed in a plane parallel to the aforementioned plane) whereby said upper and lower guide rollers 21 and 22 are disposed on the facing surfaces of the mounting plates 19 and 20. A cliché holder 24 is displaceably guided between the upper and lower guide rollers 21 and 22 whereby the cliché holder 24 is supported by its upper side 25 and its lower side 26 on the upper and lower guide rollers 21 and 22 respectively and is guided by the latter such that it is precisely linearly displaceable. Its guiding by the guide rollers is virtually without play. The cliché holder 24 exhibits contact shoulders 28 on which supported from below is a cliché 30 which is held in this position by clamping bars 32 which are screwed onto the underside of the cliché holder 24 and engage the underside of the cliché 30. The clamping bars 32 thereby leave space for the lower guide rollers 22.

The cliché 30 consists of a steel plate and exhibits a completely flat upper side 35 which has been microfinished by lapping and to which has been applied an engraving (not shown) which may have been produced either actually by engraving or also by etching, particularly using a photochemical process.

Figure 3:
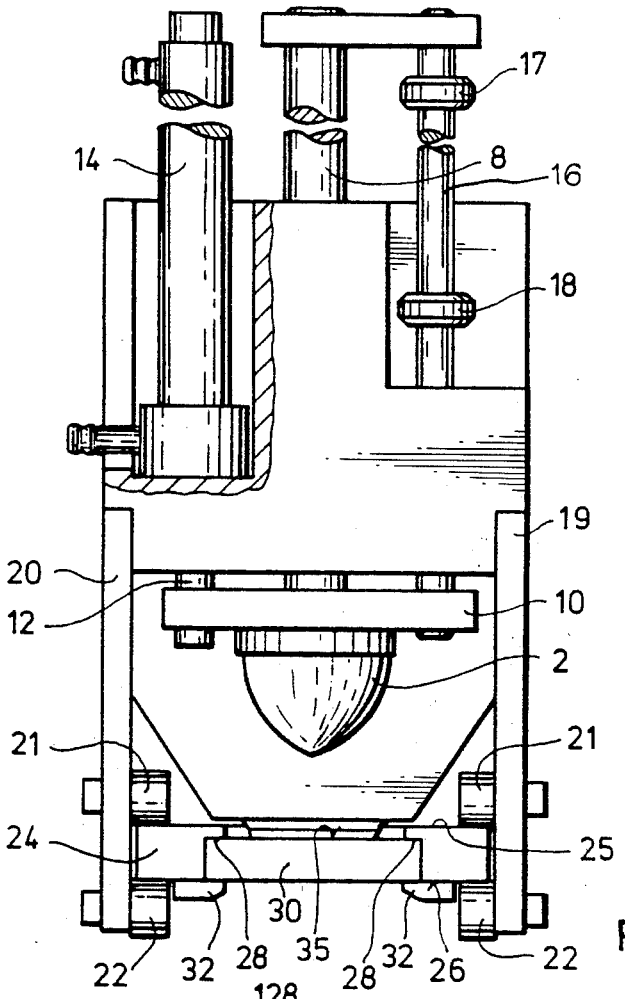
FIG. 3 is a front view of the machine in the direction of arrow III in FIG. 1, partially broken away.

Behind the cliché 30 in the view in FIG. 3 and to the right of the cliché 30 in the diagram in FIG. 1 a plate 40 is clamped into the cliché holder 24. The upper side 42 of the plate 40 is, precisely in the same manner as with the cliché 30, completely flat and microfinished by lapping. This upper side 42 does not bear any engraving. The plate 40 is pressed against the contact shoulder 28 of the cliché holder 24 by clamping bars which can be secured and released independently of the clamping bars 32 shown in FIG. 3. The cliché 30 and the plate 40 can thus, independently of each other, be secured in and released from the cliché holder 24.

The upper sides 35 of the cliché 30 and 42 of the plate 40 abut on each other without joint and lie precisely in the same plane. To guarantee this, the contact shoulder 28 of the cliché holder 24 is machined with sufficient accuracy.

The cliché holder 24 with the parts attached thereto can be moved by a pneumatic piston-cylinder unit 46 which is mounted in the frame 4 and whose piston rod 47 is connected by means of a connecting piece 48 to a connecting piece 49 abutting on the cliché holder 24 at the rear. The cliché holder 24 is displaceable in the direction of double arrow 50 by means of the piston-cylinder unit 46.

Provided in the frame 4 is a vertically extending through-hole 52 which is slightly widened in its upper end region 54. Fitted and located into a recess 56 in the lower end region of the hole 52 is a ring 58 whose radially inward-pointing surface 60 is convex in longitudinal section, see FIG. 2 in particular. Inserted into the hole 52 is a hollow body 64 which exhibits a circularly cylindrical side wall 66 which is adjoined at the top by an end wall 68 which is provided with a centric threaded hole 70. Screwed into the threaded hole 70 from above is a tube 72 which projects beyond the upper side 74 of the frame 4. The tube 72 is sealed airtight on its upper side by a removable screw plug 76.

In its lower end region the side wall 66 of the hollow body 64 exhibits a collar 80 which projects radially outward in relation to the remaining outer surface 78 of the side wall 66 and whose outer surface 82 forms the surface of a regular cylinder. The upper side 83 of the collar 80 forms a contact shoulder on which a spring 84 in the form of a compression spring, namely a helical compression spring, is supported by its lower end. The upper end of the spring 84 is supported on a shoulder 86 which is provided on a quick-seal coupling 88 which is inserted into the widened section 54 and exhibits a thumbwheel 90 at its upper end for easier operation and is held in the frame 4 with the aid of projections 92 in the manner of a bayonet catch. The quick-seal coupling 88 is through-drilled over its length, and the diameter of this hole 94 is greater than the outside diameter of the tube 72 with the result that the quick-seal coupling 88 does not hinder any lateral movements of the tube 72 or, consequently, corresponding movements of the hollow body 64.

In the specimen embodiment it is assumed that the spring 84 is designed such that, without further adjustment possibility, it transmits the desired contact force onto the collar 80. If an adjustment of the contact force is to be provided, this can be done without difficulty in that, instead of the quick-seal coupling 88, there is a screw basically of the same dimensions as the latter whereby the section 54 of the hole 52 is then in the form of a threaded hole. The contact force of the spring 84 can in this case be adjusted by appropriately screwing in this screw which replaces the quick-seal coupling 88.

Toward its lower end, below the collar 80, the wall thickness of the hollow body 64 decreases. The narrow, annular end face 96 (see FIG. 2*a*) of the hollow body 64 which abuts on the cliché 30 is, like the upper side of the cliché 30 and of the plate 42, highly accurately flat and lapped. So that the end face 96 exhibits high dimensional stability and resistance to wear the hollow body 94 is made of a hard material in the immediate vicinity of the end face 96. In the example, the lower end region of the hollow body 64 is formed by a ring 98 of hard material, cemented carbides in the example, exhibiting the end face 96, whereas the remainder of the hollow body 64 is comprised of steel. The ring 98 is manufactured by sintering and is joined to the remaining hollow body 64 by means of hard-soldering.

Instead of using a separate ring 98 of hard material, it would also be possible for the lowermost region of the hollow body 64 to be manufactured from steel to which cemented carbides or hard metal oxides are applied by means of a suitable coating method, particularly the plasma spraying method, whereby, here too, the necessary smoothness of the end face 96 is subsequently produced by smoothing and lapping.

Inside the hollow body 66 is printing ink 110 which has been poured in through the tube 72. Since the lower end face 96 of the hollow body rests very tightly on the upper side of the cliché 30 and is pressed on by the compression spring 84 it is impossible for the ink to escape. The printing ink contains a relatively high proportion of volatile solvents.

The distance between the upper side 83 of the collar 80 and the lower end face 96 is approximately half the size of the diameter of the hollow body 66 in the region of its lower end face 96.

Situated below the pad 2 in a plane below the cliché holder 24 together with the clamping bars 32 attached thereto is an object 115 which is to be printed and which is indicated merely in the region of its upper side which is to be printed.

The depicted machine works as follows: By means of the piston-cylinder unit 46 the cliché holder 24 is moved forward, i.e. to the left in FIG. 1, until the plate 40 has assumed precisely that position which the cliché 30 assumes in FIG. 1. In the course of this movement the end face 96 of the cemented-carbide ring 98 wipes excess ink from the upper side of the cliché 30 so that ink remains only in the recesses in the upper side of the cliché. This inked region of the cliché is now under the pad 2. Compressed air is now supplied to the piston-cylinder unit 14 which moves the pad 2 downward and presses it onto the cliché. Then the pad 2 is again lifted off the cliché and takes with it the printing ink from the recessed areas of the cliché. The piston-cylinder unit 46 now moves the cliché holder 24 back into the position shown in FIG. 1. Then the pad 2 is moved downward by the piston-cylinder unit 14 and is pressed onto the object 115, as a result of which the latter is printed. Then the pad 2 is again raised into the position shown in FIG. 1. A further object to be printed is brought to the place in which is situated the object 115 in FIG. 1, and the above-described process of the machine is repeated. The position assumed by the cliché 30 when it is ready for the ink to be accepted from it by the pad 2 is shown by dash-dotted lines in FIG. 1. In the time during which the cliché 30 is in the region below the pad 2 the surface of the plate 40 is tightly in contact with the end face 96 of the hollow body 64 and prevents the escape of ink. Since the upper sides of the cliché 30 and of the plate 40 abut on each other in a precise fit also in the region of their point of contact, it is virtually impossible for any printing ink to escape from inside the hollow body 64, apart from that printing ink which is within the recesses in the cliché and is to be accepted by the pad 2.

The pad 2 is made of a silicone rubber and is elastically deformable. The contact force with which the pad 2 is pressed against the upper side of the cliché 30 is best dimensioned such that the pad is deformed only to such an extent and is in flat contact with the cliché only over such an area as is necessary for accepting the ink from the engraved area of the cliché. With the cliché 30 in the position shown in FIG. 1, it is best for the engraved area of the cliché to be at a distance on all sides from the inner limit of the end face 96. This ensures that the pad 2 does not accept slight traces of ink which may collect at the edge of that area of the cliché 30 and of the plate 40 which is wiped by the end face 96 during the shifting motion of the cliché holder 24. Conversely, the cliché is wiped off completely cleanly in the area within this aforementioned edge area.

The hollow body 64 is held in its position by the ring 58, whose convex inner surface permits a slight swivelling motion of the collar 80 about axes extending parallel to the upper side of the cliché, and by the compression spring 84. Since the compression spring 84 engages the collar 80 in a region just above the upper side of the cliché, there is a favourable lever arm which tends to prevent any tilting of the hollow body 64 as a result of frictional forces occurring during the shifting motion of the cliché carrier 24. It must be remembered, however, that the printing ink used has a certain lubricating and thus friction-reducing effect. Due to the depicted swivelling ability in the region of the ring 58 and due to the constant downforce of the spring 84 the end face 96 is always and everywhere in tight contact with the upper side of the cliché 30 and with the upper side of the plate 40. This results in sealing on all sides. The pressure with which the lower end face 96 is in contact with the upper side of the cliché 30 and of the plate 40 is also approximately equal over the entire circumferential area of the end face 96. This prevents uneven wear, particularly of the upper side of the cliché. Consequently, the service life of the cliché is very long. The end face 96 is virtually not subject to wear.

Due to the good sealing in the region of the lower end face 96 it is not necessary to remove the printing ink 110 from the machine when the machine is shut down, even if the machine is shut down for the weekend.

Printing with the machine can be started immediately when work is recommenced without any elaborate cleaning operations.

If the cliché 30 is to be exchanged, it is merely necessary, starting from the position shown in FIG. 1, to shift the cliché carrier 24 forward into the position marked by dash-dotted lines without lowering the pad 2 onto the cliché 2. The cliché 30 is then exchanged. During this time the escape of printing ink 110 from inside the hollow body 66 is prevented by the plate 40.

Figure 2:
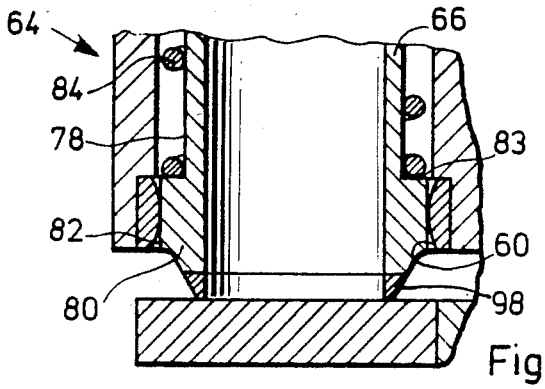
FIG. 2 shows detail II in FIG. 1 on a larger scale.
Figure 2A:
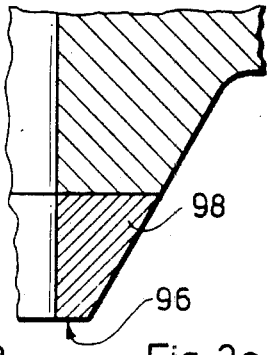
FIG. 2*a* shows an enlarged detail of FIG. 2.

The embodiment shown in FIG. **2*b* differs from the embodiment shown in FIGS. 1 to 2*a* in that the hollow body identified in this case by reference number 64*a* exhibits a support surface 83*a* for the spring 84 which is lower than in FIG. 2. The convex surface 60' corresponding to the surface 60 also offers support for the hollow body 64*a*, this support being lower than in FIG. 2. In the specimen embodiment this support formed by the surface 60' is 6.5 mm above the upper side of the cliché, and the surface 83*a*** is 8 mm above the upper side of the cliché.

Figure 4:
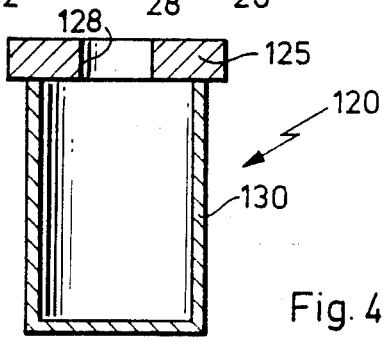
FIG. 4 shows a section at right angles to the plane of FIG. 1 through a removal device for ink.

If the printing ink 110 is to be removed from the hollow body 66, for example in order to be able to print a different colour, then use is made of the auxiliary unit 120 used in FIG. 4.

The auxiliary unit 120 is shown in a section at right angles to the plane of the drawing in FIG. 1. In its upper region it exhibits a plate 125 whose dimensions correspond entirely to the dimensions of the cliché 30 and of the plate 40. The plate 125 is microfinished particularly on its upper side. To remove the ink 110, the cliché 30 is exchanged for the auxiliary unit 120 in the above-depicted manner. After exchanging, the cliché carrier 24 is moved back into the position shown in FIG. 1 and a hole 128 which is disposed in the plate 125 and penetrates the latter is now in contact with the inside of the hollow body 64. The screw plug 76 is now loosened and, because air is now able to enter the hollow body 64, the printing ink 110 flows into a container 130 provided under the plate 125 on the auxiliary unit 120. Like that of the plate 40, the upper side of the plate 125 is microfinished and, when the auxiliary unit 120 is mounted, merges steplessly into the upper side of the plate 40. It goes without saying that the container 130 may also be larger than in the specimen embodiment. After the printing ink 110 has been drained, it may be practical to flush out the inside of the hollow body 64 through the tube 72 with solvent in order to clean it. The hollow body 64 remains in its place during such cleaning operations. The auxiliary unit 120 can then once again be exchanged for the cliché 30 or a different cliché 30, and new printing ink is poured into the hollow body 64, and work can then be continued with the machine.

Figure 5:
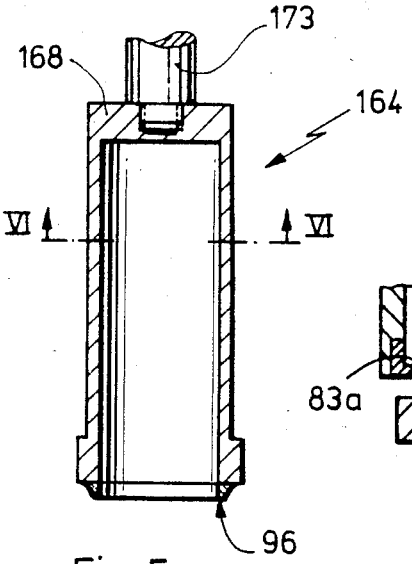
FIG. 5 shows a longitudinal section through a hollow body open on one side only.
Figure 2B:
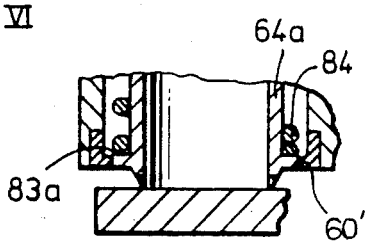
FIG. 2*b* shows a detail of a further specimen embodiment corresponding to FIG. 2*a;*

FIG. 5 shows a hollow body 164 which differs from the specimen embodiment shown in FIG. 1. The hollow body 164 is completely closed in the region of its upper end wall 168, and, therefore, instead of the tube 72 a rod 173 of solid material is screwed into the end wall 168. Like the tube 172, this rod 173 is used, among other things, also for inserting the hollow body and for removing the hollow body for any maintenance operations.

In a machine employing the hollow body 164, it is practical for the entire machine to be able to swivel such that it can be rotated so that the end face 96 of the hollow body 164 points upward. In this position, the hollow body 164 is then taken out of the machine from below with the aid of the rod 173 (after releasing the quick-seal coupling 88) if printing ink is to be poured into the hollow body or removed from it. Thus, in this embodiment, the printing ink is poured into the hollow body 164 while the hollow body 164 is outside the machine; the hollow body is then re-inserted into the machine from below. If changing inks, the removal of printing ink from the hollow body 164 is performed in the same manner, but in the reverse order: after the machine has been rotated so that the end face 96 is pointing upward, the hollow body 164 is taken out of the machine from below so that there is no risk of the machine being dirtied by the ink. The hollow body is then poured out, cleaned and provided with new ink before being re-introduced into the machine.

Figure 6:
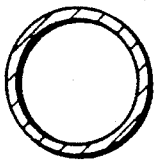
FIG. 6 shows a cross section on line VI—VI in FIG. 5.

The cross section of the hollow bodies 64 and 164 is, as shown in FIG. 6, circularly cylindrical.

Figure 7:
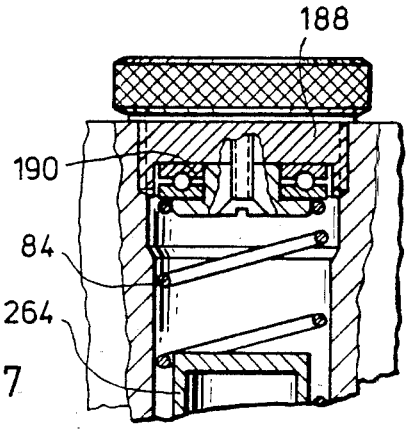
FIG. 7 shows a further specimen embodiment of a clamping device.

FIG. 7 shows a design differing from that in FIG. 5. In this case, the contact force of the spring 84 is adjustable in the above-described manner by means of a screw 188 which replaces the quick-seal coupling 88. The upper end of the spring 84 is supported on the screw 188 through the intermediary of an axial ball bearing 190 so that the screw 188 is easily adjustable. In this case, there is no rod 173. The hollow body 264 is open only in the region of its end face 96.

The drive for the pad 2 need not necessarily exhibit a stroke limitation by means of setting rings 17 and 18. It is also possible to supply the piston-cylinder unit 14 with a pressure medium, particularly compressed air, which produces a constant pressure within the piston-cylinder unit 14 during the downward motion of the pad 2. The stroking motion of the pad 2 is then limited by the fact that the pad 2 comes up against, firstly, the upper side of the cliché 30 and, secondly, the upper side of the object 115 being printed and is deformed in the desired manner and to the desired extent in accordance with the set pressure and the elastic properties of the silicone rubber.

A great advantage of the machine shown is that the cliché carrier 24 has only a very short displacement travel between that position in which the cliché 30 is inked and that position in which the ink is accepted from the cliché 30 by the pad. Among other things, this is due to the fact that there is no need for an additional wiping blade. Due to this small displacement travel and the fact that even at high displacement velocities of the cliché carrier 24 the end face 96 of the hollow body 64 or 164 is always tightly up against the upper side of the cliché carrier 24, the printing machine is capable of achieving a very high printing rate. In an actual specimen embodiment in which, however, the cliché holder 24 and the pad 2 are still not driven at the maximum possible speed, 7000 printing operations per hour were obtained. It can be assumed that 10 000 printing operations per hour or more are possible without difficulty. By comparison, only approximately 2500 printing operations per hour are currently possible using known machines.

In the specimen embodiment the hollow body 64/164 has an inside diameter of 25 mm and a clear height of 90 mm. It is practical for the width of the lower end face 96 to be between 0.1 and 0.5 mm, 0.3 mm in the example. The ring 98 is made of so-called cemented carbides, that is a sintered material made using metallic hard solids of the kind used, for example, also for metal-cutting tools.

The displacement travel of the cliché holder 24 is 50 mm. The remaining dimensions can be taken from the scale drawing.

The machine 200 shown in FIGS. 8 to 11 differs from the machine shown in FIGS. 1 to 7 in the area of the hollow body which is in this case identified by the reference number 202. The hollow body 202 basically comprises two parts 204 and 210 which are joined together such that they are able to move in relation to each other. With the exception of its uppermost region the part 204 is U-shaped in its horizontal cross section. It exhibits a vertical flat wall 206 which is adjoined by side walls 207 and 208 which form the legs of the U and extend basically at right angles to the wall 206. The vertical end faces of the side walls 207 and 208 are highly accurately flat and lapped. The part 210 also exhibits an upper wall 209 extending at right angles to the wall 206 and to the side walls 207 and 208. At their lower end region the walls 206, 207 and 208 taper and at this point bear a cemented-carbide strip 205 which tapers further toward the bottom and whose lower end face, like the end face of the ring 98 in FIG. 2*a*, forms a wiping edge. The wiping edge formed on each wall 206, 207 and 208 by the cemented-carbide strip 205 extends straight.

The part 210 is basically a mirror image of the part 204. The wall 212 extending parallel to the wall 206 thus, together with side walls which are identified in this case by the reference numbers 213 and 214, forms a U in the horizontal cross section, and an upper wall 215 adjoins in the upper region. While the upper wall 209 is closed, the upper wall 215 is provided with a threaded hole 216 which makes it possible at this point to screw in a screw plug or, if desired, to attach a hose for the continuous or periodic supply of ink.

The vertical end faces of the side walls 207, 208 and 213, 214 and of the upper walls 209 and 215 abut on each other whereby the two parts are pressed against each other by spring action. Since the contacting end faces are highly accurately flat, the joint between the two parts 204 and 210 is leak-tight in respect of ink. The two parts are held together by a total of four screws 220 to 223. Of these, the screws 220 and 221 are disposed in the lower part of the hollow body 202 so that they extend through the side walls 207, 208, 213, 214 while the screws 222 and 223 in the upper part of the hollow body 202 extend through the upper walls 209, 215 at a distance from the side walls. The screws 220 to 223 each exhibit a head 224 which presses a helical spring 225 against a shoulder 226 of the part 204 whereas the threaded part 228 of the screws engages a matching female thread in the part 210. The rotary position of the aforementioned screws is secured by grub screws 230 which serve as locking screws and also prevent the screws 220 to 223 from being screwed in too far. The fact that the heads 224 in no case contact the part 204 prevents any highly uneven clamping together of the two parts 204 and 210, which might lead to damage, and also to leaking. The screws 220 to 223 including their threaded parts 228 are seated in the part 204 with slight lateral play so that the parts 204 and 210 are able to move slightly in relation to each other along their contact surface. This ensures that, independently of production tolerances, the cemented-carbide strip 205 of both parts 204 can abut exactly on the surface of the flat cliché 30.

Figure 8:
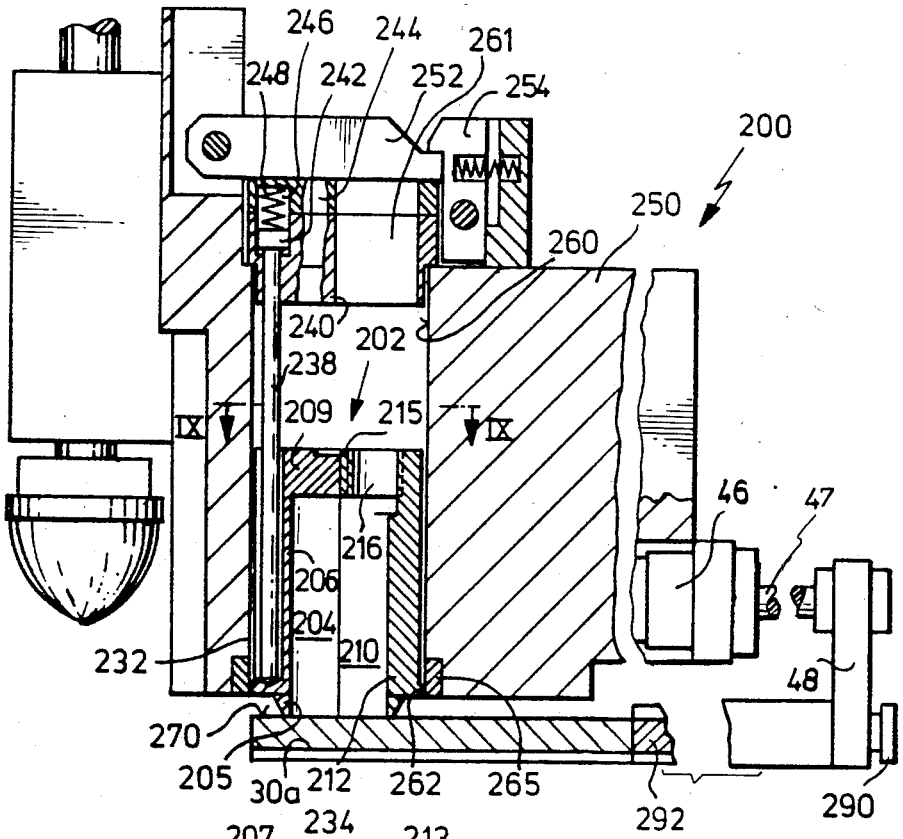
FIG. 8 is a representation of another specimen embodiment similar to FIG. 1 whereby the hollow body is cut on line A—A in FIG. 9.
Figure 9:
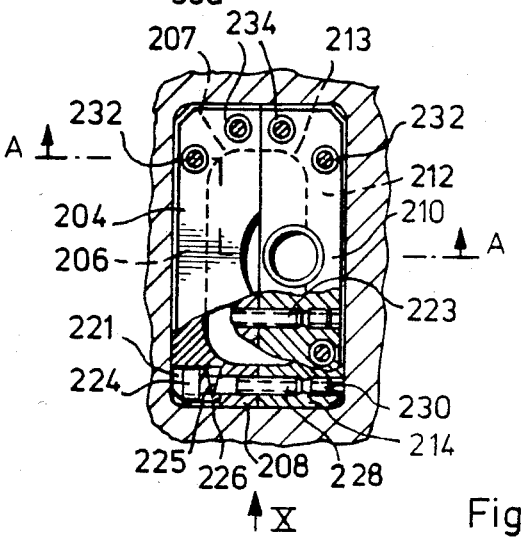
FIG. 9 shows a section on line IX—IX in FIG. 8, opened in two different planes.
Figure 10:
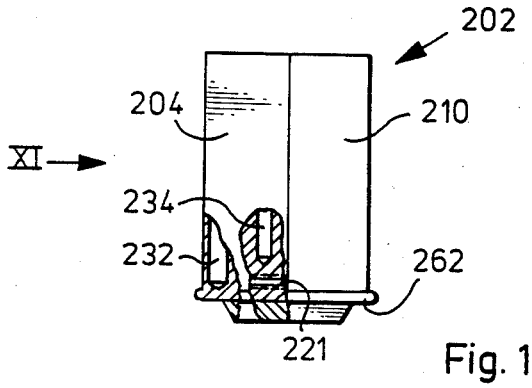
FIG. 10 shows a view of the hollow body in the direction of arrow X in FIG. 9.
Figure 11:
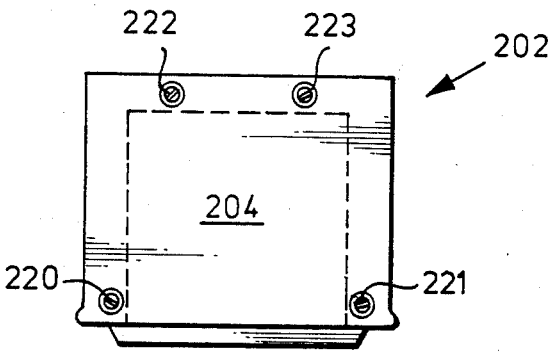
FIG. 11 is a view of the hollow body in the direction of arrow XI in FIG. 10.

Provided in each of the parts 204 and 210 of the hollow body 202 are four holes extending parallel to the plane of the drawing in FIG. 8 and at right angles to the plane of the drawing in FIG. 9, and open at the top in FIG. 8, of which the holes 232 are provided in the walls 206 and 212, yet in the vicinity of the corners of the rectangular hollow body 202, whereas the holes 234 are provided in the side walls 207 and 208 in the immediate vicinity of the contact surface between the two parts 204 and 210. The lower end of the holes 232 is placed as deep as possible, and is situated just above the cemented-carbide strip 205. Since the longitudinal direction of the holes 234 intersects the screws 224 extending through the side walls, the holes 234 are not quite as deep as the holes 232, as shown in FIG. 10. Inserted into the holes 232 and 234 from above are rods 238 which, with their lower ends, press on the bottoms of the holes 232 and 234. The rods 238 do not touch the side walls of the holes 232 and 234. The upper end sections of the rods 238 are guided in a bearing part 240 whereby a widened head 242 of the rods 238 ensures that the rods cannot drop downward out of the bearing part 240 when the latter is removed from above. Above the bearing part 240 there is a counter-piece 244 which is provided from below with several holes 246 in each of which is disposed a spring 248 which exerts a downward-acting force on the head 242. So that, against the force of the springs 248, the counter-piece 244 is held in its place and in contact with the upper side of the bearing part 240, it is locked by a locking bar 252 which is swivel-mounted in a housing 250 and which is held in its locking position by a spring-loaded catch 254. If the catch 254 is swung back, the locking bar 252 can be swung upward and it is then possible to remove the parts 240 and 244 from above together with the rods 238. The hollow body 202 can then be removed from above. The exact position of the bearing piece 240 is ensured by the fact that a narrower section of this piece engages a recess 260 of rectangular cross section which penetrates the housing 250 from top to bottom. A continuous recess 261 in the parts 240 and 244 makes it possible to route a hose from above to the threaded hole 216.

When seen in a top view, with the exception of the slightly bevelled corners, the hollow body 202 likewise exhibits a rectangular cross section which, however, with the exception of its lowermost region, is slightly smaller than the cross section of the recess 260. Merely in the lowermost region of the hollow body 202 does the latter at its whole circumference exhibit a circularly continuous, outward-projecting, convexly arched bead 262 which abuts the wall of the recess 260 with a precise fit. In its lowermost region the recess 260 is lined by strips 265 of hardened steel which are inserted into the housing 250 so that there is a virtually non- wearing flat support surface for the bead 262. Since above the bead 262 the hollow body 202 has a smaller cross section than the recess 260 it is able to swivel slightly in the recess 260 about two horizontal swivelling axes which in FIG. 8 extend perpendicularly to the plane of the drawing and in the horizontal direction, thus making it possible for the wiping edge formed by the cemented-carbide strips 205 always to be in precise contact with the surface of the cliché.

The visible height of the hollow body in FIG. 8, measured on the outside, is 60 mm. The visible maximum width in FIG. 8 in the region of the bead 262 is 40 mm. The length of the hollow body transverse to the shifting direction of the cliché is, likewise measured in the region of the bead, 69 mm. The support formed by the bead 262 is 6.5 mm above the upper side 270 of the cliché. The point of engagement of the rod 238 inside the hole 232 is almost at the same height, namely about 7.5 to 8 mm above the upper side 270 of the cliché. Conversely, in the holes 234 the point of engagement of the rod 238 is about 13 mm above the upper side 270. The remaining dimensions can be taken from the scale drawing.

Another difference between the machine 200 and the machine 1 is that a different cliché is used. In this case, instead of the cliché 30 and the plate 40, use is made of a cliché **30*a* whose length corresponds to the sum of the lengths of the cliché 30 and of the plate 40. Hence, it is not necessary to ensure an absolutely stepless transition between the surfaces of the cliché 30 and of the plate 40. During normal operation of the machine the cemented-carbide parts 205 thus always slide on the absolutely flat and stepless surface of the cliché 30*a*. If the cliché 30*a* is to be exchanged, it is first of all moved to the left until it assumes the position shown by dash-dotted lines in FIG. 1. Then a fastening screw 290 connecting the cliché carrier to the connecting piece 48 is loosened, and the entire cliché carrier is now moved further forward, i.e. to the left in FIG. 8. A plate 292 which adjoins the cliché 30*a* and whose surface is machined with high precision then comes under the hollow body 202 and seals the latter while the cliché 30*a*** is exchanged.

Figure 12:
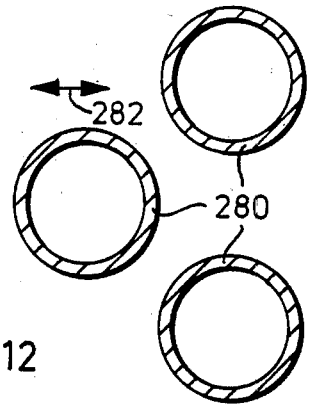
FIG. 12 shows diagrammatically the position of several hollow bodies of a machine.

FIG. 12 shows diagrammatically in a horizontal cross section the position of three hollow bodies 280 of round cross section which, with respect to the shifting direction of the cliché indicated by a double arrow 282, are disposed offset to one another both in this shifting direction as well as transversely to it in a housing of a further specimen embodiment.

The machines which have been shown are particularly suitable as an integrated printing unit in production lines, packaging lines, filling plants and assembly lines working at high cycle speeds. They are suitable both for the printing of completely flat objects as well as for the printing of irregularly shaped objects. The maintenance operations to be performed on the printing machines require only little time; they are virtually limited to topping up with ink from time to time, for example at the end of a shift, or, if necessary, exchanging a cliché. These activities can be performed by semi-skilled staff.

The machines according to the invention are particularly advantageous because in automatic production lines many uneven parts have to be labelled and dated whereby this calls for encoding prints or other prints. Such tasks can easily be performed by the machines according to the invention and permit the making of such prints even in places where this has hitherto been impossible due to the absence of a suitable machine. From one steel cliché it is possible to make 100 000 to 300 000 prints on the machine.

Cemented carbide is a material which is usually used also for the cutting edges of metal-cutting tools. Such cemented carbides contain hard solids, e.g. tungsten carbide. The hardness of the cemented carbides is comparable to a Rockwell hardness HRC=1600 (Rockwell hardness is defined only up to max. HRC=100). Preferably, steel with a hardness HRC=64 is used for the cliché. The good sliding properties of the cemented carbides on the steel are also of importance with regard to the selection of steel.

If ceramic is used as the hard material, this may contain silicon carbide or aluminium oxide.

It has already been mentioned that the microfinished surfaces are preferably lapped. In this case, it is possible to obtain a peak-to-valley height of 0.4 μm. Conversely, the diameter of colour pigments is generally between 3 and 4 μm.

The total force with which the eight springs in the specimen embodiment in FIG. 8 press the hollow body 202 against the cliché is 20 daN (deca Newton).

The reference numbers in the claims do not limit the invention, but are intended to facilitate comprehension.

What is claimed is:

1. A pad-type printing machine having a mount and a cliché, ink means exhibiting a hollow body mounted thereon, whereby during the operation of the machine the end face of the hollow body rests at least occasionally on the cliché, pressing means for pressing the end face of the hollow body against the cliché, motion means for producing a relative motion between the cliché and the hollow body, whereby the hollow body is guided such that it can swivel about an axis extending basically parallel to the relative motion, and pad means adapted to be pressed onto the inked cliché and which accepts the ink from the recesses in the cliché and transfers it onto an object to be printed, wherein at least on some of the circumference of its end face (96) the hollow body (64, **64*a*, 164, 264, 202) exhibits hard material and is microfinished with a peak-to-valley height of at most 2 μm whereby the pressing means (84, 88, 188, 238, 246) for pressing the hollow body against the cliché (30) is designed such that the contact force acts in the immediate vicinity of the contact surface between the cliché and the hollow body and is at least approximately uniformly distributed over the circumference of the end face, whereby the hollow body is guided such that it can additionally swivel about an axis extending transversely to the relative motion between the cliché and the hollow body, said hollow body (202) exhibiting parts (204,210) which are able to move in relation to each other and are joined together so as to be leak-tight in respect of liquids, whereby a part of the end face is provided on one part (204) of the hollow body and another part of the end face is provided on another part (210**) of the hollow body.

2. Machine as defined in claim 1, wherein the hollow body (202) is divided into two parts (204, 210), each of which exhibits a wall (206, 212), two side walls (207, 208, 213, 214) disposed at right angles to the latter, and a ceiling wall (209, 215) extending basically at right angles to the wall and the side walls, whereby the side walls of the two parts (204, 210) abut on each other with end faces extending basically at right angles to the plane of the cliché (30).

3. Machine as defined in claim 1, wherein the individual parts (204, 210) of the hollow body are pressed against the cliché (30*a*) by a clamping device.

4. Machine as defined in claim 3, wherein each of the parts of the hollow body has its own clamping device.

5. Machine as defined in claim 3, wherein the clamping device exhibits several rods (238), one end of which is supported through the intermediary of a spring (248) on a housing (250) accommodating the hollow body (202) while the other end is supported on the hollow body (202).

6. Machine as defined in claim 1, wherein the parts (204, 210) of the hollow body are pressed against each other by spring force.

7. A pad-type printing machine having a mount and a cliché, ink means exhibiting a hollow body mounted thereon, whereby during the operation of the machine the end face of the hollow body rests at least occasionally on the cliché, pressing means for pressing the end face of the hollow body against the cliché, motion means for producing a relative motion between the cliché and the hollow body, whereby the hollow body is guided such that it can swivel about an axis extending basically parallel to the relative motion, and pad means adapted to be pressed onto the inked cliché and which accepts the ink from the recesses in the cliché and transfers it onto an object to be printed, wherein at least on some of the circumference of its end face (96) the hollow body (64, 64*a*, 164, 264, 202) exhibits hard material and is microfinished with a peak-to-valley height of at most 2 μm whereby the pressing means (84, 88, 188,238, 246) for pressing the hollow body against the cliché (30) is designed such that the contact force acts in the immediate vicinity of the contact surface between the cliché and the hollow body and is at least approximately uniformly distributed over the circumference of the end face, whereby the hollow body is guided such that it can additionally swivel about an axis extending transversely to the relative motion between the cliché and the hollow body, and a cliché carrier (24) which, in the direction of the relative motion between the cliché (30, 30*a*) and the hollow body (64, 164, 264), is at least twice as long as the length of the print which is to be made, whereby the cliché carrier (24) is designed to hold a number of plates such that one of the plates cliché (30, 30*a*) can be exchanged while another of the plates (40) completely closes off the hollow body whereby at least one of the plates is a cliché (30, 30*a*) whereby the plate which does not form a cliché is microfinished in the manner of a cliché on its side (42) facing the hollow body (64, 164, 264, 202).

8. Machine as defined in claim 7, wherein one (125) of the plates provided for insertion in the cliché carrier is designed such that its surface facing the hollow body makes a leak-type joint with the latters's end face whereby the plate (125) exhibits an opening (128) through which printing ink (110) contained in the hollow body (64) can be discharged.

* * * * *

UNITED STATES PATENT AND TRADEMARK OFFICE

CERTIFICATE OF CORRECTION

PATENT NO. : 4,557,195

DATED : December 10, 1985

INVENTOR(S) : Wilfried Phlipp

It is certified that error appears in the above-identified patent and that said Letters Patent are hereby corrected as shown below:

On the title page, Item [76]:

The name of the patentee is changed to: WILFRIED PHILIPP.

Signed and Sealed this

*Fifteenth* Day of *July 1986*

[SEAL]

*Attest:*

DONALD J. QUIGG

*Attesting Officer*

*Commissioner of Patents and Trademarks*